US011217169B2

(12) United States Patent
Masaoka

(10) Patent No.: US 11,217,169 B2
(45) Date of Patent: Jan. 4, 2022

(54) DISPLAY DEVICE WITH REFERENCE PIXEL CIRCUIT

(71) Applicant: SHENZHEN TOREY MICROELECTRONIC TECHNOLOGY CO. LTD., Shenzhen (CN)

(72) Inventor: Akira Masaoka, Sakai (JP)

(73) Assignee: SHENZHEN TOREY MICROELECTRONIC TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 16/748,459

(22) Filed: Jan. 21, 2020

(65) Prior Publication Data

US 2020/0243011 A1 Jul. 30, 2020

Related U.S. Application Data

(60) Provisional application No. 62/798,756, filed on Jan. 30, 2019.

(51) Int. Cl.

| | |
|---|---|
| ***G09G 3/32*** | (2016.01) |
| ***G09G 3/3241*** | (2016.01) |
| ***G09G 3/00*** | (2006.01) |

(52) U.S. Cl.

CPC ..... *G09G 3/3241* (2013.01); *G09G 3/006* (2013.01); *G09G 2310/0286* (2013.01); *G09G 2320/045* (2013.01); *G09G 2330/12* (2013.01)

(58) Field of Classification Search

CPC .. G09G 3/32; G09G 3/006; G09G 2310/0286; G09G 2320/045; G09G 2330/12; G09G 3/3241

See application file for complete search history.

(56) References Cited

U.S. PATENT DOCUMENTS

| | | | | |
|---|---|---|---|---|
| 2016/0104422 | A1 | 4/2016 | Kishi et al. | |
| 2016/0300534 | A1 | 10/2016 | Kishi | |
| 2017/0039939 | A1 * | 2/2017 | Chaji | G09G 3/3225 |
| 2019/0191119 | A1 * | 6/2019 | Takamoto | H04N 5/3742 |
| 2020/0105195 | A1 * | 4/2020 | Song | G09G 3/3291 |
| 2020/0193918 | A1 * | 6/2020 | Hwang | G09G 3/3266 |
| 2020/0335044 | A1 * | 10/2020 | Kawachi | G09G 3/3233 |

FOREIGN PATENT DOCUMENTS

| | | |
|---|---|---|
| WO | 2015/016196 A1 | 2/2015 |
| WO | 2015/093097 A1 | 6/2015 |

* cited by examiner

*Primary Examiner* — Pegeman Karimi
(74) *Attorney, Agent, or Firm* — ScienBiziP, P.C.

(57) ABSTRACT

A current generation circuit that generates a current that serves as a current, a plurality of pixels arranged adjacent to one another, a source driver that supplies the same current to each of the plurality of pixels, an integrating circuit that measures the current, an ADC that converts a result of the measurement into digital data, and a control circuit that corrects degradation of other pixels 11 on the basis of the digital data obtained by the ADC using, as the reference, the current that serves as the reference.

16 Claims, 16 Drawing Sheets

| | INTEGRATING CIRCUIT 1 | INTEGRATING CIRCUIT 2 | INTEGRATING CIRCUIT 3 | ..... | INTEGRATING CIRCUIT 158 | INTEGRATING CIRCUIT 159 | INTEGRATING CIRCUIT 160 |
|---|---|---|---|---|---|---|---|
| R_Phase0 | Vs1 - Vref1 | Vs7 - Vs4 | Vs13 - Vs10 | ..... | Vs943 - Vs940 | Vs949 - Vs946 | Vs955 - Vs952 |
| R_Phase1 | Vs4 - Vs1 | Vs10 - Vs7 | Vs16 - Vs13 | ..... | Vs946 - Vs943 | Vs952 - Vs949 | Vs958 - Vs955 |
| G_Phase0 | Vs2 - Vref2 | Vs8 - Vs5 | Vs14 - Vs11 | ..... | Vs944 - Vs941 | Vs950 - Vs947 | Vs956 - Vs953 |
| G_Phase1 | Vs5 - Vs2 | Vs11 - Vs8 | Vs17 - Vs14 | ..... | Vs947 - Vs944 | Vs953 - Vs950 | Vs959 - Vs956 |
| B_Phase0 | Vs3 - Vref3 | Vs9 - Vs6 | Vs15 - Vs12 | ..... | Vs945 - Vs942 | Vs951 - Vs948 | Vs957 - Vs954 |
| B_Phase1 | Vs6 - Vs3 | Vs12 - Vs9 | Vs18 - Vs15 | ..... | Vs948 - Vs945 | Vs954 - Vs951 | Vs960 - Vs957 |

DISPLAY DEVICE WITH REFERENCE PIXEL CIRCUIT

BACKGROUND

1. Field

The present disclosure relates to a display device.

2. Description of the Related Art

With organic light-emitting display devices employing an active matrix method, response speed, light emission efficiency, and luminance are high and viewing angle is large. Organic light-emitting display devices are therefore enthusiastically being developed.

In a general organic light-emitting display device, driving transistors that control driving current flowing into organic light-emitting diodes (hereinafter simply referred to as "OLEDs") and pixel circuits including the OLEDs are arranged in matrix. The luminance of pixels is adjusted in accordance with a video signal in order to display an image. The luminance of pixels can be adjusted by controlling the driving current with gate voltage of the driving transistors.

OLEDs degrade (burn-in occurs) over time or due to locally high luminance display for an extended period of time, for example, and luminance locally decreases. This causes a large difference in luminance from nearby pixels and unevenness in the luminance of displayed images. In image display devices including OLEDs as pixels, such unevenness in luminance due to degradation is to be corrected.

In Japanese Unexamined Patent Application Publication (Translation of PCT Application) No. WO2015/093097, a current measuring circuit is provided for each column of a display device and measures a current value of a pixel selected in each line. Because the measured current value varies depending on an effect of temporal degradation, this example of the related art describes means for correcting a video signal using the current value on the basis of correction data prepared in advance.

In Japanese Unexamined Patent Application Publication (Translation of PCT Application) No. WO2015/016196, a step of measuring noise is provided in addition to a step of measuring current in the above example of the related art. This example of the related art describes means for checking presence or absence of noise equal to or larger than a reference value and avoiding a decrease in correction accuracy due to noise.

In Japanese Unexamined Patent Application Publication (Translation of PCT Application) No. WO2015/093097, although the current measuring circuit in each column measures currents of pixels, the measured currents vary depending on a measurement environment (temperature, noise, etc.). Correction data, on the other hand, is prepared in advance. It is therefore difficult to create correction data while assuming every kind of measurement environment, and a video signal is undesirably not corrected accurately.

In Japanese Unexamined Patent Application Publication (Translation of PCT Application) No. WO2015/016196, deterioration of sound-to-noise (S/N) ratios of measured currents can be avoided since a video signal is not corrected when, in the step of measuring noise, there is variation caused by a measurement environment, such as noise equal to or larger than a reference value, and a video signal is corrected only when noise is smaller than the reference value. The correction, however, undesirably takes time since the step of measuring noise is added and the measurement is repeated.

SUMMARY

An aspect of the present disclosure has been conceived in view of the above problems and aims to achieve a display device capable of accurately correcting unevenness in luminance.

An embodiment of the present disclosure is a display device including a current generation circuit that generates a current that serves as a reference, a plurality of pixel circuits arranged adjacent to one another, a driving unit that supplies a same current to each of the plurality of pixel circuits, a measuring unit that measures the current using an integrating circuit, and a correction unit that corrects degradation of other pixel circuits on a basis of a result of the measurement obtained by the measuring unit using the current that serves as the reference.

DESCRIPTION OF THE EMBODIMENTS

First Embodiment

Figure 1:
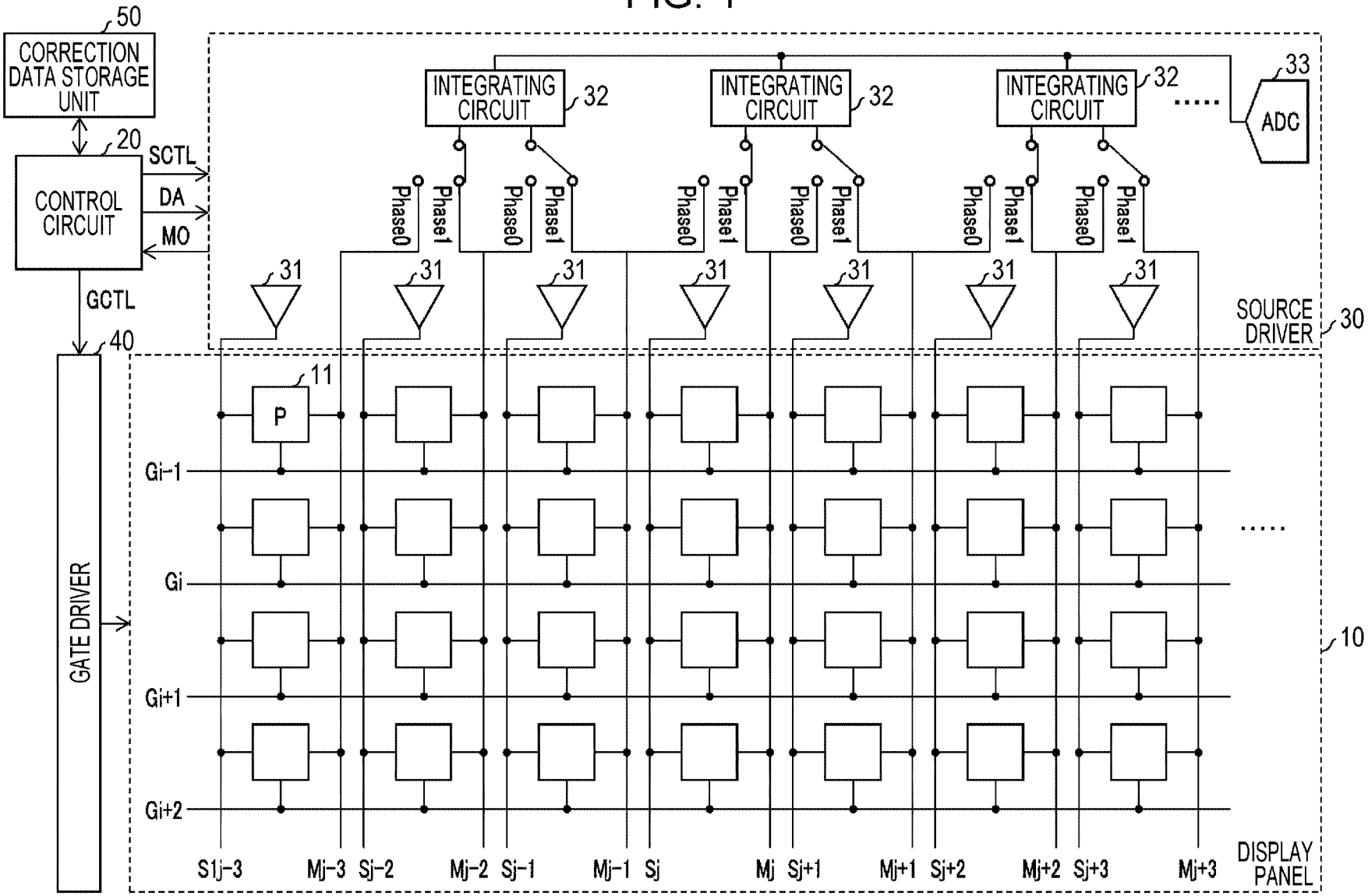
FIG. 1 is a block diagram illustrating the configuration of a display device according to a first embodiment of the present disclosure.
Figure 2A:
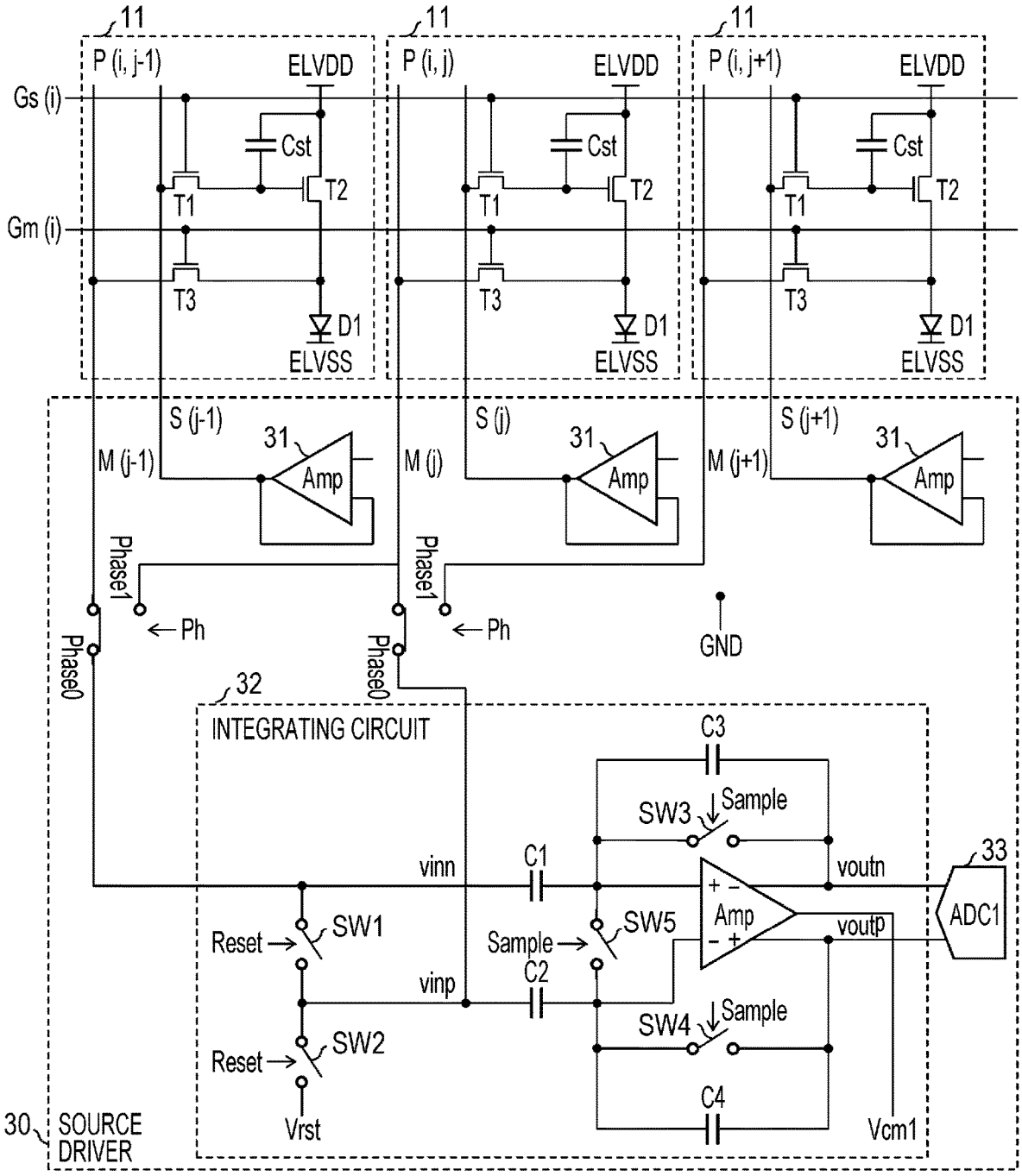
FIG. 2A is a circuit diagram illustrating an example of connection between a source driver and pixel circuits.

FIG. 2A is a connection diagram of a display panel 10 and a source driver (driving unit) 30 according to a first embodiment of the present disclosure and illustrates connection between (j−1)th to (j+1)th pixels (current generation circuits or pixel circuits) 11 in an i-th row and the source driver 30 illustrated in FIG. 1. First, the pixel configuration of the display panel 10 will be described.

Figure 2B:
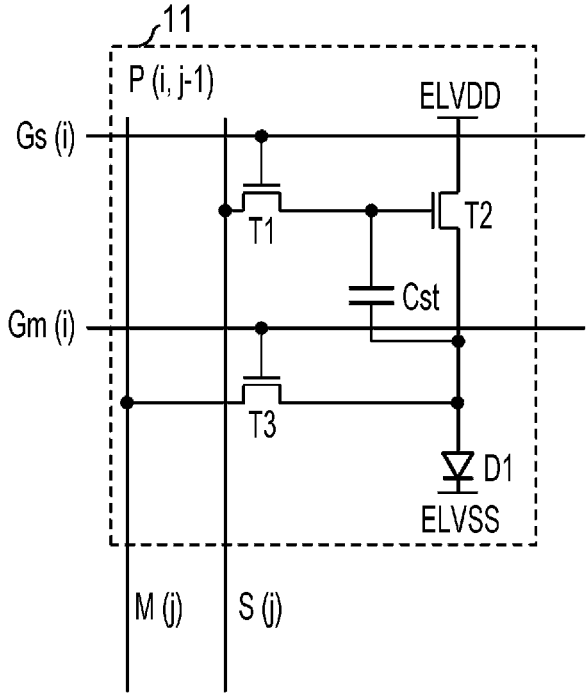
FIG. 2B is a circuit diagram illustrating an example of the configuration of one of the pixel circuits.

The pixels (P) 11 each include one OLED (D1), three transistors (T1 to T3), and one storage capacitor (Cst). The transistors T1 to T3 are of a P-type. An N-type pixel configuration is illustrated in FIG. 2B, in which how Cst is connected is different.

In both the P type and the N type, Cst is disposed between a gate and a source of T2 in order to keep gate-source voltage of T2 the same during measurement of current, which in turn keeps driving current the same.

T1 functions as an input transistor for selecting a pixel 11 and is controlled using a gate line Gs. T2 functions as a driving transistor for controlling supply of current to an OLED. Gate voltage of T2 is supplied from a source line S through T1.

T3 functions as a monitoring control transistor for controlling connection/disconnection with a monitoring line and is controlled using a gate line Gm. ELVDD and ELVSS are driving voltages for driving the pixels 11 and supplied from a power supply integrated circuit (IC), which is not illustrated in FIG. 1.

Next, the configuration of the source driver 30 will be described. The source driver 30 includes output circuits 31, phase switches, (switched capacitor) integrating circuits 32, and analog-to-digital converters (ADCs) (measuring units) 33. The output circuits 31 are connected to source lines and output certain voltages according to a video signal during normal operation and monitoring voltages for monitoring during monitoring operation.

During the monitoring operation, the phase switches switch monitoring lines to make inputs to the integrating circuits 32 using control signals Ph. When Ph is low (Phase0), M(j−1) is connected to an inverting input vinn and M(j) is connected to a non-inverting input vinp.

When Ph is high (Phase1), on the other hand, M(j) is connected to the inverting input vinn and M(j+1) is connected to the non-inverting input vinp.

As illustrated in FIG. 2A, the integrating circuits 32 each include a fully differential amplifier circuit, sampling capacitors (C1 and C2=Cs), holding capacitors (C3 and C4=Ch), and five switches (SW1, 2, 3, 4, and 5). Gain can be adjusted by adjusting a ratio of Cs to Ch.

Here, inputs of the fully differential amplifier circuits are connected to the monitoring lines through C1 and C2. Because the monitoring lines are AC coupled at C1 and C2, DC components are blocked. The integrating circuits 32 can therefore be achieved within a small range of power supply voltage without being affected by a driving voltage range of the pixels 11, which is an operation range of the monitoring lines. As a result, area and power consumption can be reduced.

Outputs of each fully differential amplifier circuit indicate a difference between time integrals of currents flowing through two monitoring lines. The difference is input to the ADC1 (33) and converted into digital data.

Figure 3:
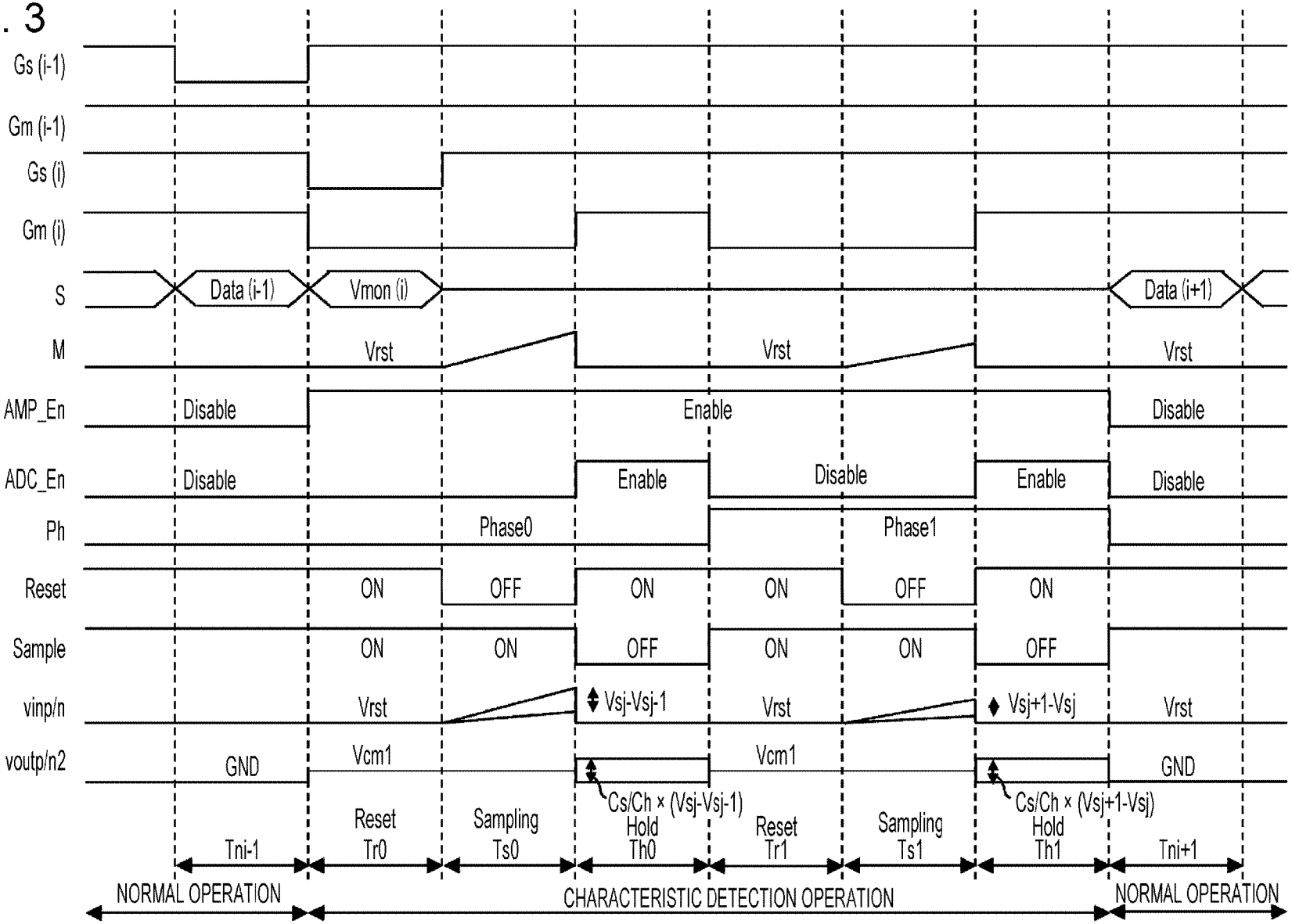
FIG. 3 is a timing chart illustrating the operation of the display device.

Next, a circuit operation according to the first embodiment will be described in detail with reference to a timing chart of FIG. 3. FIG. 3 is a timing chart at a time when the pixels 11 in first to (i−1)th rows perform the normal operation, the pixels 11 in the i-th row perform the monitoring operation for the driving transistors, and the pixels 11 in (i+1)th to last rows perform the normal operation. Here, a case where P-type transistors are used for the pixels 11 is illustrated. Here, AMP_En, ADC_En, Ph, Reset, and Sample denote control signals.

Normal Operation

Tni-1 denotes a normal operation period in the (i−1)th row, where, in the (i−1)th row, a signal Gs(i−1) of the gate line becomes low and a signal Gm(i−1) becomes high and, other than in the (i−1)th row, signals Gs of the gate lines become high and signals Gm become high.

In the pixels 11 in the (i−1)th row, T1 turn on and T3 turn off. The source driver 30 supplies data voltages according to data Data(i−1) to gates of T2. In the pixels (P) 11 other than in the (i−1)th row, T1 turn off and T3 turn off. AMP_En and ADC_En are low, the integrating circuits 32 and ADC1 (33) are Disable, and the monitoring lines M have a reset voltage (Vrst).

Correction Operation

Tr0 denotes a reset period in Phase0 of the monitoring operation, where, in the i-th row, a signal Gs(i) of the gate line becomes low and a signal Gm(i) becomes low and, other than in the i-th row, signals Gs of the gate lines become high and signals Gm become high.

In the pixels 11 in the i-th row, T1 turn on and T3 turn on. The source driver 30 supplies monitoring voltages Vmon(i) to the gates of T2, and the monitoring lines are connected to drains of T2. Vmon(i) are data voltages of the same gradation.

Vmon(i), however, are not limited to data voltages of the same gradation insofar as Vmon(i) are gate voltages for supplying a certain driving current to T2. Here, in order to reflect a result of correction obtained in a previous monitoring operation, Vmon(i) are modulated using correction data calculated in the previous monitoring operation.

Driving currents of the pixels 11 to which the corrected Vmon(i) are applied are ideally the same, but in practice, differences are caused due to temporal degradation from the previous monitoring operation.

In the pixels (P) 11 other than in the i-th row, T1 turn off and T3 turn off. This state continues until a characteristic detection operation in the i-th row is completed. The control signals during the reset period in Phase0 are as follows.

AMP_En, Sample, and Reset are high, and ADC_En and Ph are low. The integrating circuits 32 switch from Disable to Enable, and outputs voutp and voutn of the fully differential amplifier circuits are initialized to Vcm1. M(j−1) and M(j) are connected to the inverting input vinn and the non-inverting input vinp, respectively, and initialized to Vrst. Vrst is sufficiently lower than forward voltages of the OLEDs, and it is sufficient that anode voltages of the OLEDs do not exceed the forward voltages due to variation in potential during a sampling period, which will be described hereinafter.

Ts0 denotes a sampling period in Phase0 of the monitoring operation, where the signal Gs(i) of the gate line in the i-th row becomes high and T1 of the pixels in the i-th row turn off. At the same time, Reset switches from high to low. C1 and C2 are charged on the basis of a driving current of T2 of P(i, j−1) and a driving current of T2 of P(i, j), respectively, and potentials of M(j−1) and M(j) increase.

As a result, charges obtained by time-integrating the driving currents of T2 of the pixels 11 with the sampling period are accumulated in C1 and C2. During this period, the potentials of the monitoring lines increase, and source-drain voltages of T2 decrease. Since the gate-source voltages are kept the same by Cst, however, the driving currents of T2 are kept the same. If measurement errors are caused due to variation in the potentials of the monitoring lines during the sampling period, the variation in the potentials of the monitoring lines can be reduced and the measurement errors can be reduced by adjusting the ratios of Cs to Ch and increasing the gain.

Th0 denotes a holding period in Phase0 of the monitoring operation, where the signal Gm(i) of the gate line in the i-th row becomes high. In the pixels in the i-th row, T3 turn off, the drains of T2 and the monitoring lines are disconnected from each other, and the driving currents of T2 no longer flow into the monitoring lines.

At the same time, Reset and ADC_En switch from low to high, Sample switches from high to low, charges are transferred from C1 to C3 and C2 to C4, and the outputs of the integrating circuits 32 become products Cs/Ch×(Vsj−Vsj−1) of differences between time integrals of the driving currents of P(i, j) and P(i, j−1) and the gain and held until being processed by the ADC1 (33).

The outputs of the integrating circuits 32 are sequentially input to the ADC1 (33) and converted into digital data. Since the outputs are processed using the differences between adjacent pixels, common-mode noise in the monitoring lines and the power supply voltage is removed, and the measurement errors are reduced. Phase0 of the monitoring operation thus ends, and Phase1 starts.

Tr1, Ts1, and Th1 denote a reset period, a sampling period, and a holding period in Phase1 of the monitoring operation. Circuit operations in Phase1 are the same as those in Phase0, but the following operations are different.

Since the monitoring voltages Vmon(i) have been written to T2 of the pixels in the i-th row during the reset period in Phase0, the monitoring voltages Vmon(i) need not be written in Phase1. Even if the same monitoring voltages as in Phase0 are written in Phase1, however, the same effect can be produced.

After the monitoring operation in Phase1 starts, Ph switches from Low to High, M(j) and M(j+1) are connected to the inverting input vinn and the non-inverting input vinp, respectively, and the integrating circuits 32 output products Cs/Ch×(Vsj+1−Vsj) of differences between time integrals of the driving currents of P(i, j+1) and P(i, j) and the gain.

Output signals of the integrating circuits 32 are held and sequentially converted by the ADC1 (33) into digital data. The monitoring of the i-th row is thus completed. Differences between time integrals of driving currents of adjacent pixels in the i-th row can be obtained, and the driving currents of the pixels 11 can be obtained. Although a case where current is measured once has been described, current can be measured a plurality of times by performing the same circuit operations.

Figure 4A:
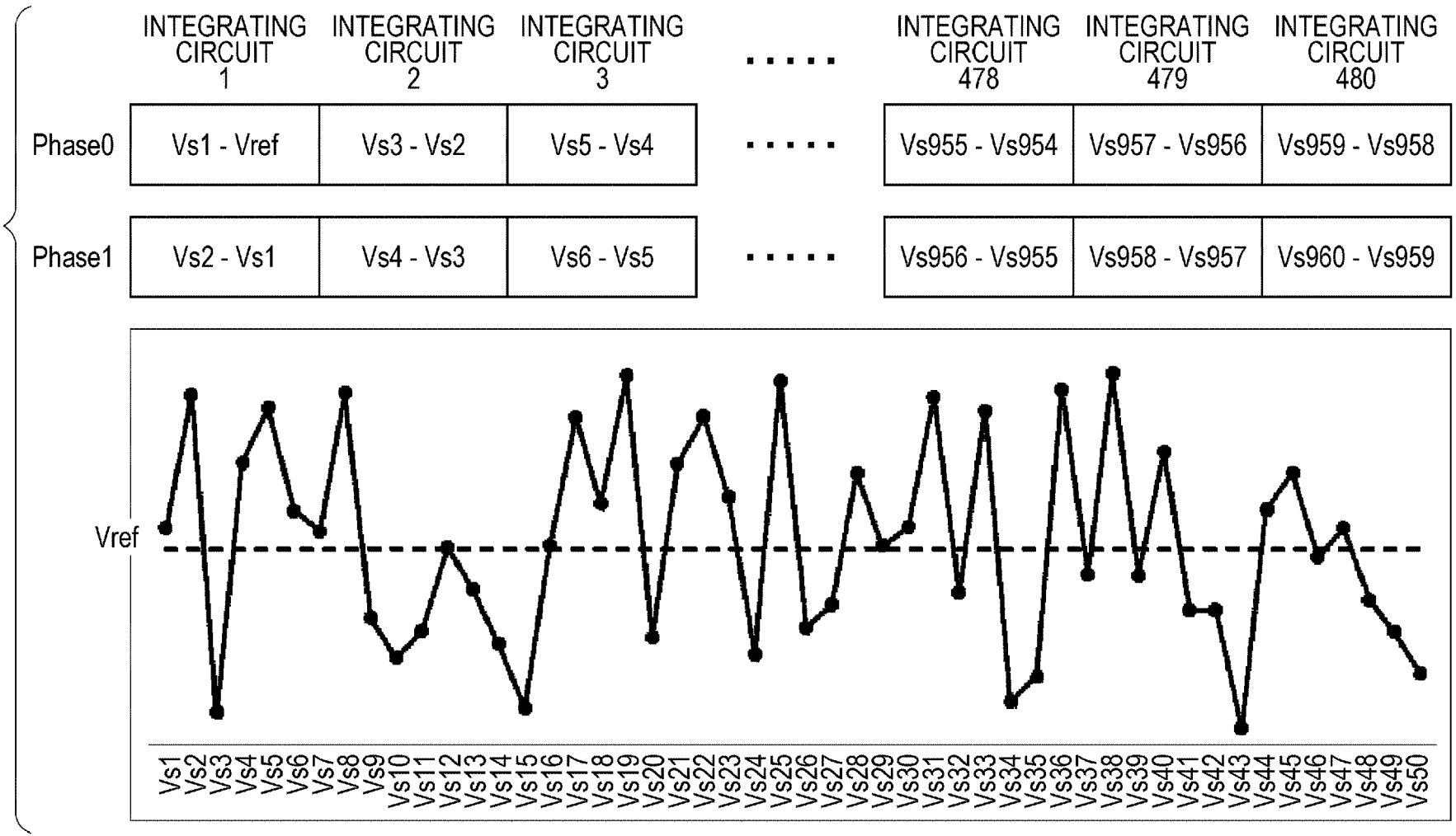
FIGS. 4A and 4B are diagrams illustrating output modes of integrating circuits.
Figure 4B:
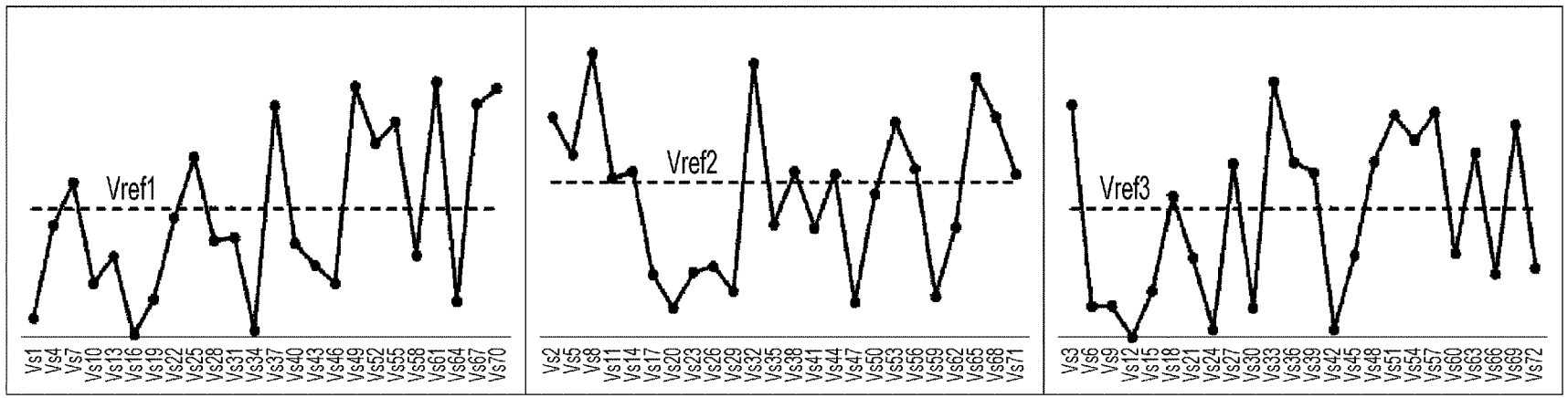

Next, a method for calculating a driving current from differences between driving currents of adjacent pixels will be described with reference to FIGS. 4A and 4B. FIGS. 4A and 4B illustrate outputs of the integrating circuits 32 during the monitoring operation at a time when there are 960 source lines.

In FIG. 4A, the integrating circuits 32 output differences (Vsja−Vsja−1) between monitoring lines in odd-numbered columns and monitoring lines in even-numbered columns in Phase0 and differences (Vsja+1−Vsja) between the monitoring lines in the even-numbered columns and the monitoring lines in the odd-numbered columns in Phase1 (ja=1, 3, . . . , 957, and 959).

Here, Cs=Ch. Results obtained by the integrating circuits 32 in Phase0 are Vs1−Vs0, and Vs0 is a current integral Vref that serves as a reference for the current generation circuits. Vref, which is the reference value, will be described in detail later.

As illustrated in FIG. 4A, a time integral of the driving current of each pixel 11 based on the integral Vref, which is a time integral of the current of the current generation circuit can be calculated. A difference between the time integral of the driving current of each pixel 11 and Vref is used to remove common-mode noise due to the measurement environment and accurately measure the amount of change in the driving current of the pixel 11 due to temporal degradation.

The calculation method in the present disclosure is used in comparative measurement between adjacent pixels. Since differences between driving currents of adjacent pixels are directly measured, differences in luminance between the adjacent pixels can be accurately corrected.

Although an example in which the driving current of each pixel 11 is calculated from differences between adjacent pixels has been described with reference to FIG. 4A, differences between adjacent pixels of the same color may be obtained as illustrated in FIG. 4B, instead, when the pixels 11 are arranged in RGB.

That is, the present patent is not limited to measurement of differences between pixels physically adjacent to each other and may be measurement of differences between adjacent pixels having the same characteristics. The integrating circuits 32 output Vsjb1+3−Vsjb1 (jb1=1, 4, 7, . . . , 952, and 955) in R_Phase0/1, Vsjb2+3−Vsjb2 (jb2=2, 5, 8, . . . , 953, and 956) in G_Phase0/1, and Vsjb3+3−Vsjb3 (jb3=3, 6, 9, . . . , 954, and 957) in B Phase0/1. Here, different values of Vref (Vref1, 2, and 3) are set for R, G, and B, and a time integral of a driving current of each pixel 11 based on Vref for each color is calculated.

Figure 5:
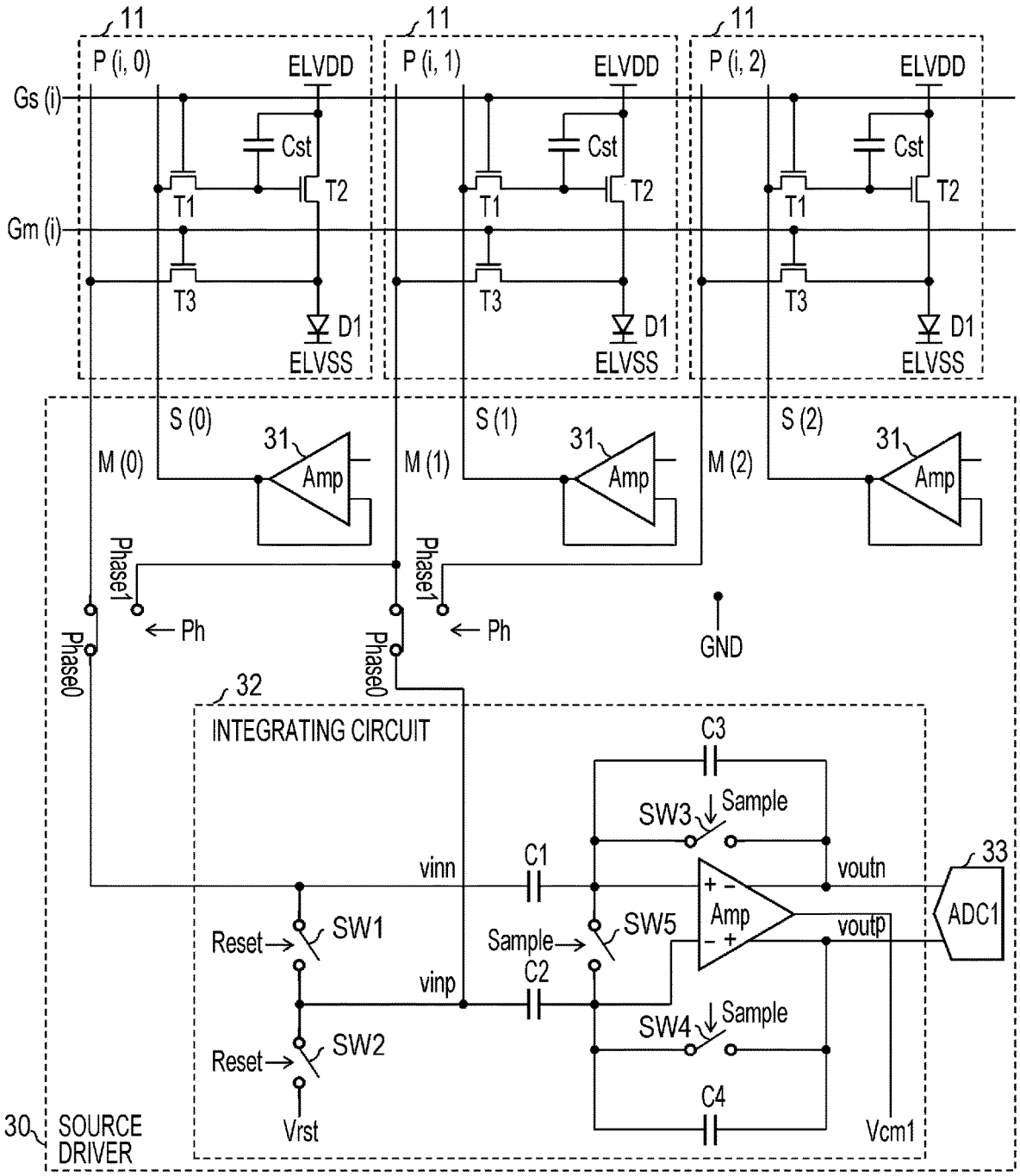
FIG. 5 is a circuit diagram illustrating an example of the connection between the source driver and the pixel circuits.
Figure 6:
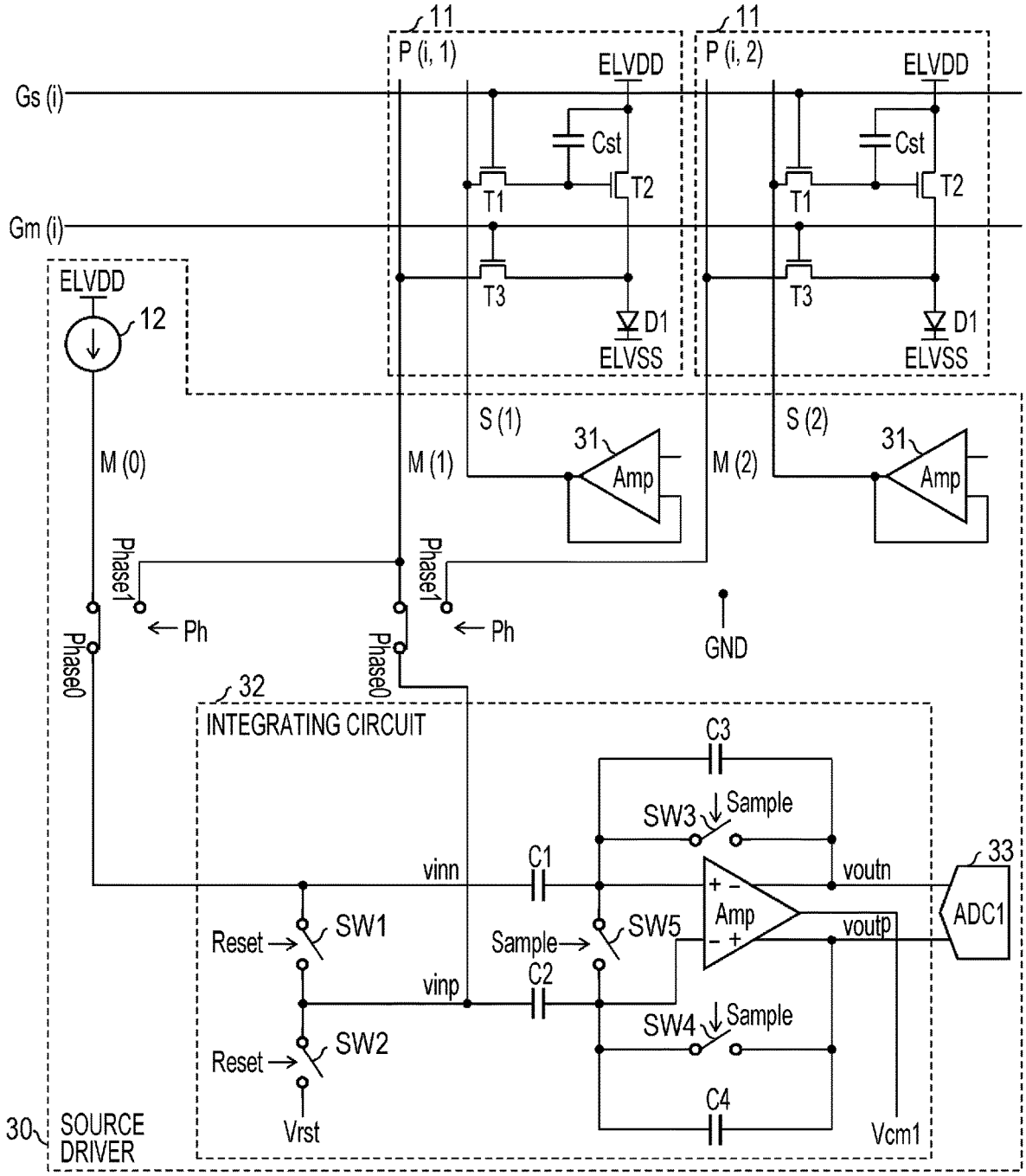
FIG. 6 is a circuit diagram illustrating another example of the connection between the source driver and the pixel circuits.

FIGS. 5 and 6 illustrate the configuration of current generation circuits in the present disclosure. FIG. 5 illustrates a configuration at a time when j=1 in FIG. 2A. P(i, 0) denotes a current generation circuit, and there is a reference pixel that is not used in the normal operation.

Figure 7:
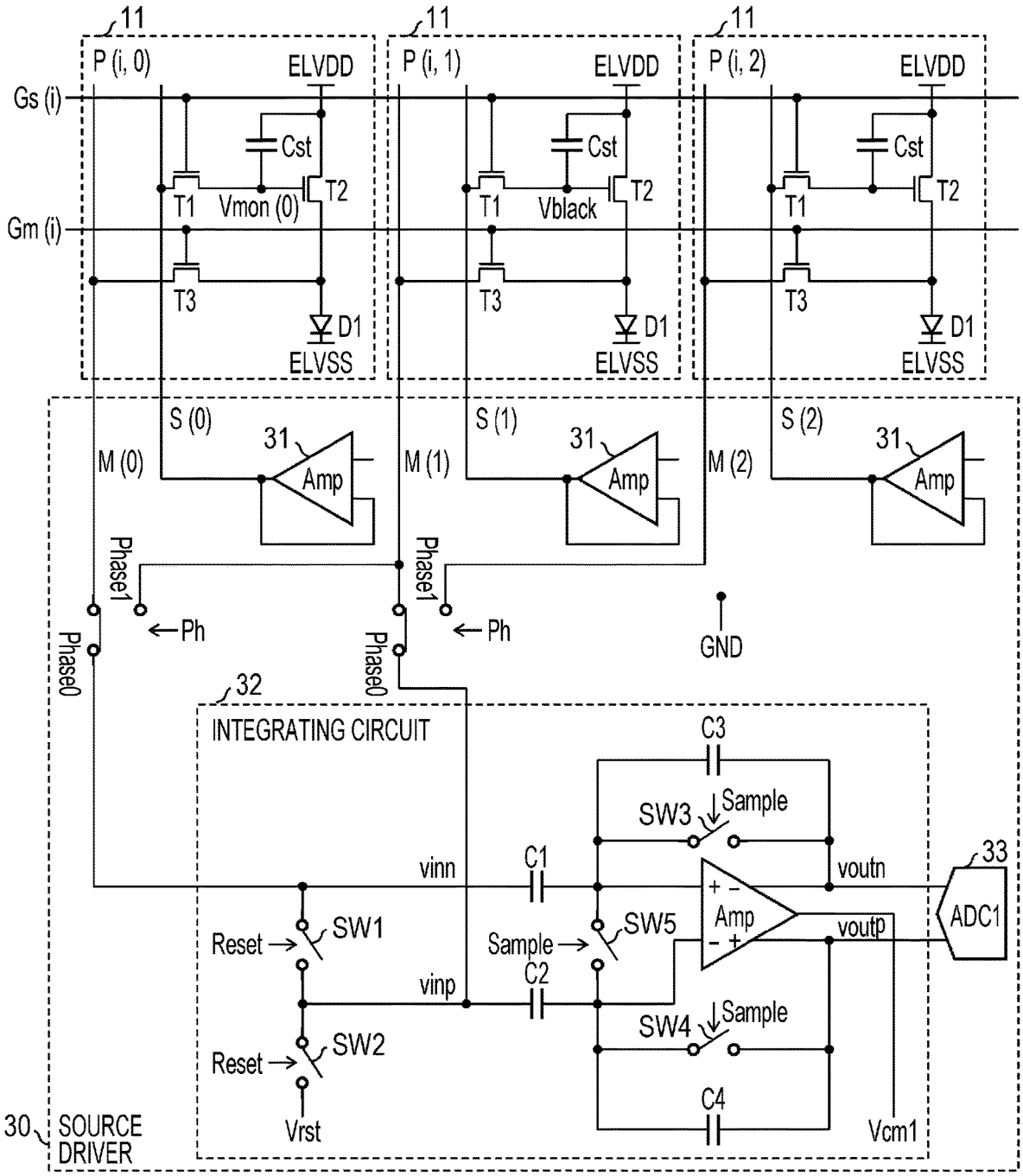
FIG. 7 is a circuit diagram illustrating another example of the connection between the source driver and the pixel circuits.

A driving transistor of the reference pixel, therefore, does not degrade over time. If manufacturing variation is corrected through measurement of current during shipping inspection, the reference pixel can generate a current that serves as a reference, which is a target value of the monitoring operation. In the measurement of current during the shipping inspection, an inspection apparatus measures current or the method illustrated in FIG. 7 is used to measure current.

A current source 12 (current generation circuit) of the source driver 30 is connected to current generation circuits illustrated in FIG. 6, and a current output from the current source 12 serves as a reference in the monitoring operation. The amount of current from the current source 12 has been adjusted in the shipping inspection of the source driver 30 and known. Alternatively, the current may be adjusted to any amount of current through register control.

Because the circuits illustrated in FIG. 6 do not include the reference pixel illustrated in FIG. 5, the configuration of the display panel 10 can be simplified. Since the current source 12 is provided in the source driver 30, however, there is a problem in that the current generation circuit does not include an effect of power supply noise of the display panel 10 and the like.

Because a driving power supply ELVDD of the display panel 10 is used as a power supply for the current source 12 in FIG. 6, the effect of the power supply noise of the display panel 10 can be removed even if differences between the current source 12 and driving currents of pixel circuits are measured.

FIG. 7 illustrates a method for measuring the current of the reference pixel illustrated in FIG. 5 using the circuit of the source driver 30. The monitoring operation in Phase0 according to the first embodiment is performed with a voltage Vblack in black display applied to P(i, 1) and Vmon(0) applied to the reference pixel P(i, 0). Since P(i, 1) is in black display, the driving current of T2 does not flow. During the sampling period, therefore, C1 is charged by the driving current of T2 of the reference pixel, and C2 is not charged. As a result, an absolute value of the driving current of the reference pixel can be measured.

A display device according to an embodiment of the present disclosure includes a pixel P(i, 0) that generates a current that serves as a reference, a plurality of pixels 11 arranged adjacent to the pixel P(i, 0), a source driver 30 that supplies the same current to each of the pixels 11, an integrating circuit 32 that measures the current, an ADC 33 that converts a result of the measurement into digital data, and a control circuit (correction unit) 20 that corrects degradation of other pixels 11 on the basis of the digital data obtained by the ADC 33 using, as the reference, the current that serves as the reference (refer to FIG. 1). The pixel P(i, 0) includes a reference pixel having the same configuration as each of the pixels 11. The reference pixel operates only during the measurement of the current and does not degrade over time.

Correction data is stored in the control circuit 20, and the control circuit 20 corrects the monitoring voltage Vmon(i) on the basis of the correction data. The control circuit 20 controls the operation of the source driver 30 by giving a data signal DA and source control signals SCTL to the source driver 30 and the operation of a gate driver 40 by giving gate control signals GCTL to the gate driver 40.

The source control signals SCTL include, for example, a source start pulse, a source clock, and a latch strobe signal that have been used conventionally. The gate control signals GCTL include, for example, a gate start pulse, a gate clock, and an output enable signal.

The control circuit 20 receives monitoring data MO supplied from the source driver 30 and updates correction data stored in a correction data storage unit 50. The monitoring data MO is data measured in order to obtain TFT characteristics or OLED characteristics.

The gate driver 40 is connected to n scanning lines Gi. The gate driver 40 includes a shift register, a logic circuit, and the like. In the display device according to the present embodiment, a video signal (original data of the data signal DA) transmitted from the outside is corrected on the basis of the TFT characteristic and the OLED characteristics.

The display device according to an embodiment of the present disclosure further includes a switch that switches connection between pixels 11 and an integrating circuit 32. The integrating circuit 32 measures a difference between currents flowing into adjacent pixels 11.

Roles of the integrating circuits 32 and the ADCs 33 are different between the first and second embodiments and a third embodiment, which will be described later. In the first and second embodiments, the ADCs 33 convert, into digital data, results obtained by individually time-integrating currents of the driving transistors (T2) and the OLEDs (D1) of the pixels 11 using the integrating circuits 32.

In the third embodiment, which will be described later, the ADCs 33 convert anode voltages of the OLEDs (D1) into digital data and also convert, into digital data, results obtained by time-integrating currents flowing into the driving transistors and the OLEDs (D1) of the pixels 11 in series with each other using the integrating circuits 32.

The display device according to an embodiment of the present disclosure adds a reference pixel column that supplies a reference current that serves as a reference in measurement to the outside of a matrix of a display unit. The reference pixel column including a reference pixel does not operate other than in the monitoring operation.

In addition, a comparison circuit is included for every two columns including the reference pixel column. The comparison circuit calculates and corrects errors from the reference pixel by measuring differences between adjacent pixels in each row.

Since differences between currents of the reference pixel and pixel circuits of the display unit in the display device, variation errors due to the measurement environment are not caused, and correction can be accurately performed. In addition, since differences between adjacent pixels are directly measured, differences in luminance between the adjacent pixels can be accurately corrected.

Second Embodiment

Figure 8:
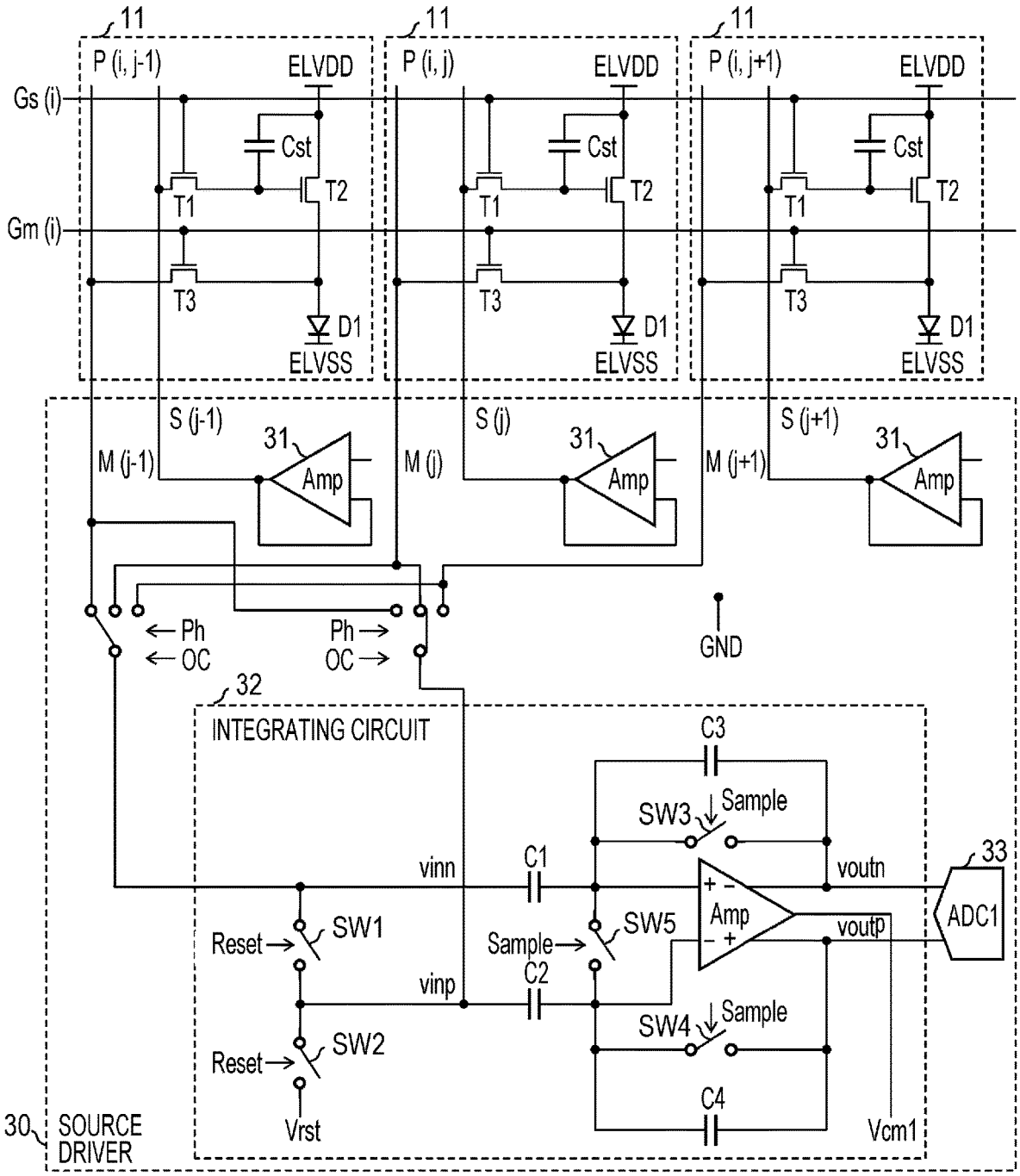
FIG. 8 is a circuit diagram illustrating another example of the connection between the source driver and the pixel circuits.

FIG. 8 is a connection diagram of a display panel 10 and a source driver 30 according to the second embodiment and illustrates connection to the (j−1)th to (j+1)th pixels (P) 11 in the i-th row illustrated in FIG. 1. The pixel configuration of the display panel 10 is the same as that illustrated in FIG. 2A. Connection of switches in the configuration of the source driver 30 is different from that illustrated in FIG. 1, and this difference which will be described hereinafter.

The switches switch between a control signal Ph for switching Phase0/1 and OC for controlling an offset canceling operation. Offset canceling herein refers to canceling of mismatches in differential inputs of the integrating circuits 32.

Mismatches in differential inputs are mismatch between transistors and capacitors. When Ph is low and OC is low (Phase 0 and OC0), M(j−1) is connected to the inverting input vinn and M(j) is connected to the non-inverting input vinp.

When Ph is high and OC is low (Phase 1 and OC0), on the other hand, M(j) is connected to the inverting input vinn and M(j+1) is connected to the non-inverting input vinp. This operation is the same as in the first embodiment.

When Ph is low and OC is high (Phase0 and OC1), M(j) is connected to the inverting input and M(j−1) is connected to the non-inverting input vinp. When Ph is high and OC is high (Phase1 and OC1), on the other hand, M(j+1) is connected to the inverting input vinn and M(j) is connected to the non-inverting input vinp.

Figure 10:
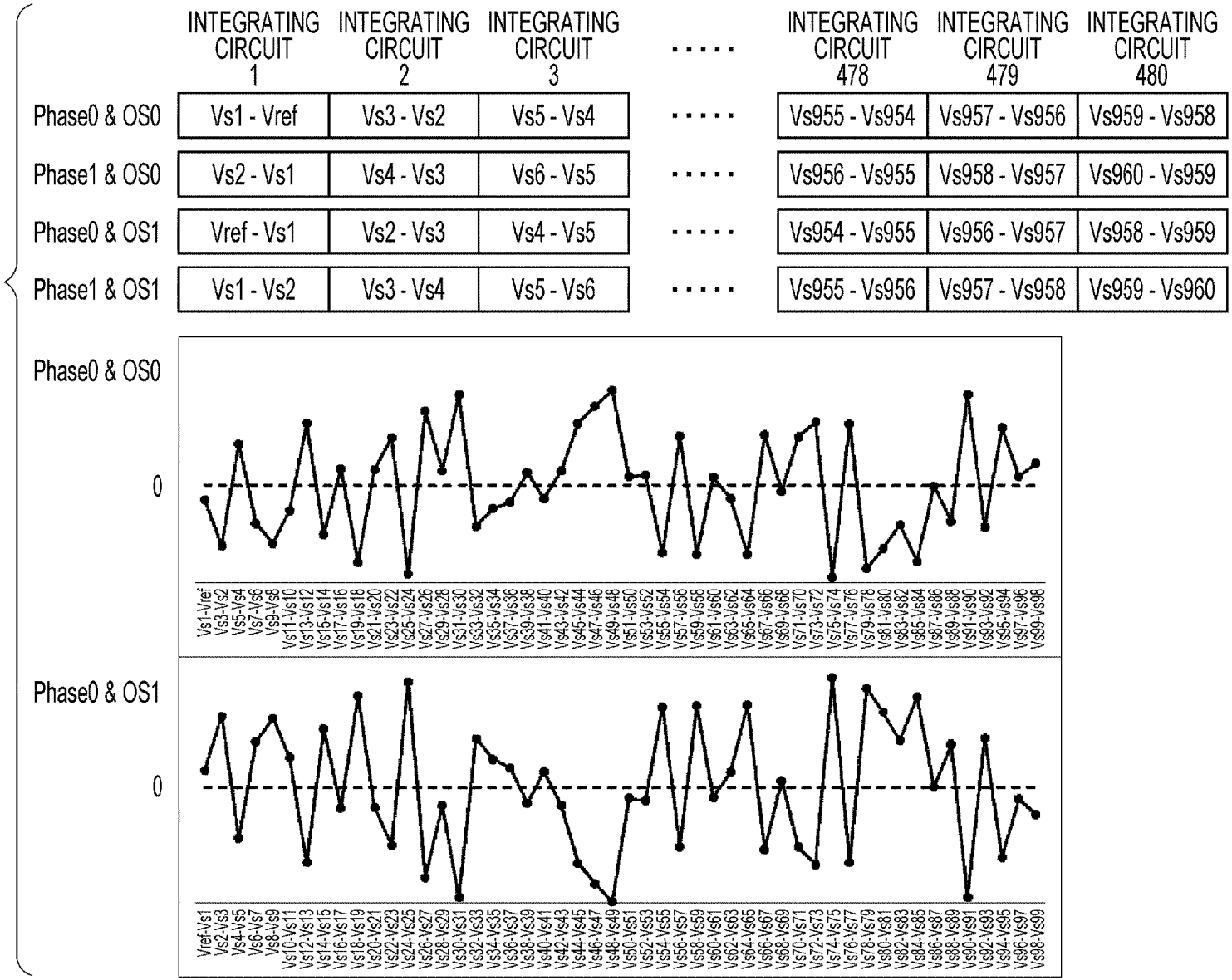
FIG. 10 is a diagram illustrating another output mode of the integrating circuits.

FIG. 10 illustrates outputs of the integrating circuits 32 during the monitoring operation at a time when there are 960 source lines. In the case of OC0, the outputs of the integrating circuits 32 are the same as those of the integrating circuits 32 according to the first embodiment illustrated in FIG. 4A.

In the case of OC1, results inverse to the outputs of the integrating circuits 32 according to the first embodiment in terms of positive and negative are obtained. That is, errors ΔVmis due to mismatches in the differential inputs of the integrating circuits 32 can be canceled by obtaining differences between outputs with OC0 (Vsja−Vsja−1+ΔVmis) and outputs with OC1 (Vsja−1−Vsja+ΔVmis). At the same time, because averaging can be simultaneously performed, measurement accuracy further improves.

Figure 9:
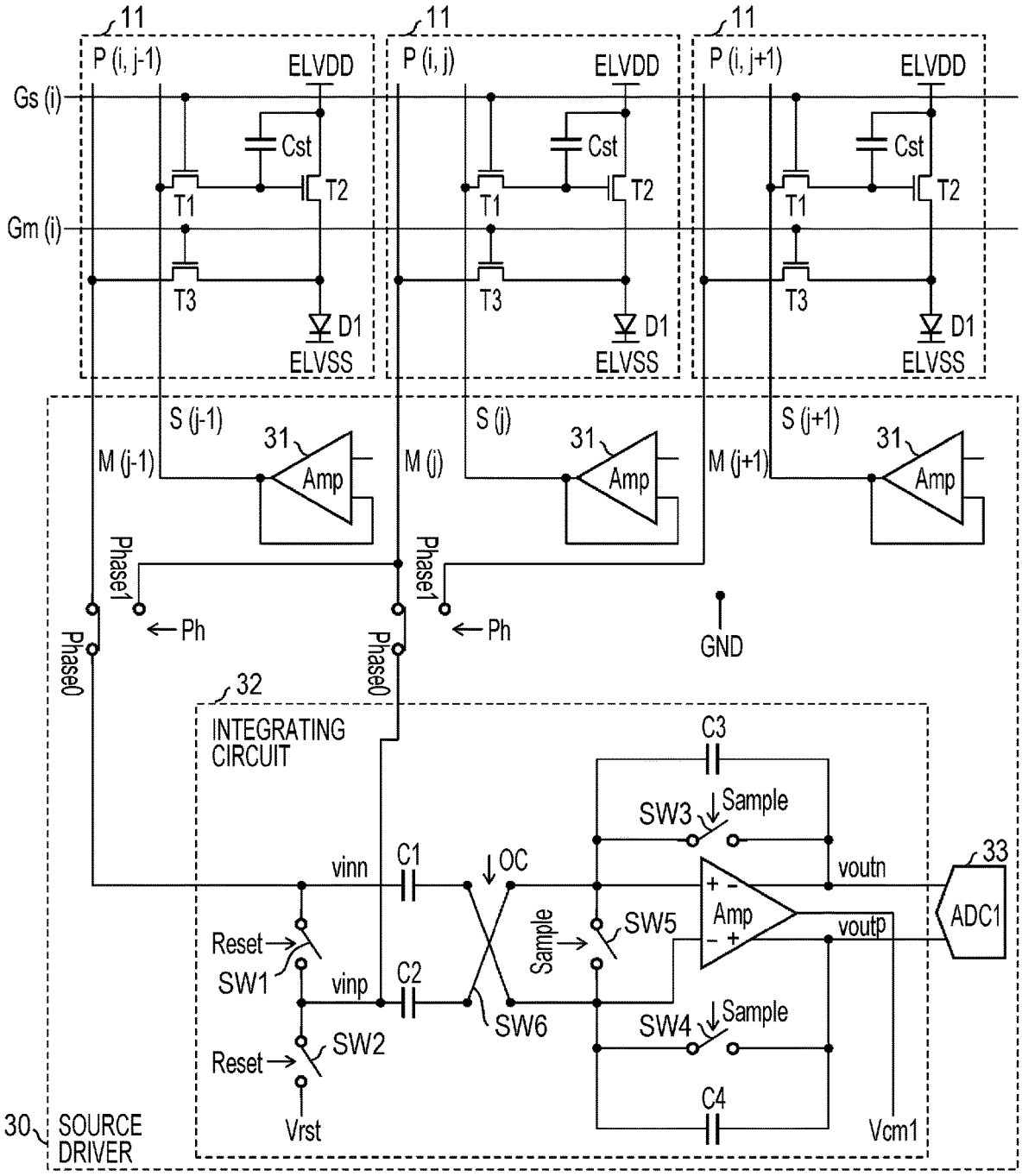
FIG. 9 is a circuit diagram illustrating another example of the connection between the source driver and the pixel circuits.

Although OC is used to switch between the inverting input and the non-inverting input on a side of the display panel 10 relative to C1 and C2 in FIG. 8, the same effect can be produced even when a switch SW6, which is provided on a side of the amplifier relative to C1 and C2, is used as illustrated in FIG. 9.

Third Embodiment

Figure 11:
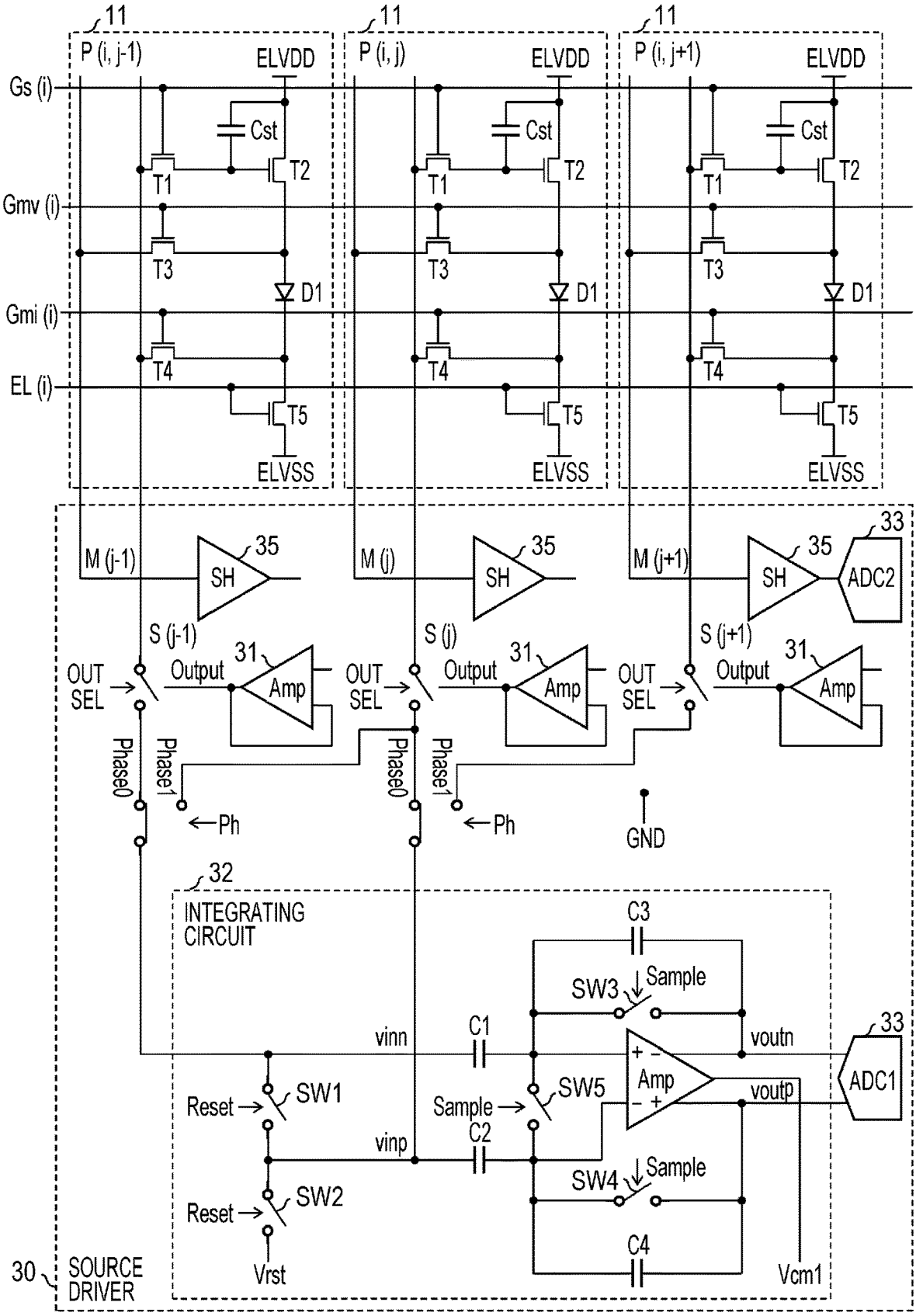
FIG. 11 is a circuit diagram illustrating another example of the connection between the source driver and the pixel circuits.

In the first and second embodiments, currents of driving transistors and OLEDs are to be individually measured as in PTL 1. In the third embodiment, a method for simultaneously measuring currents of driving transistors and OLEDs will be described. FIG. 11 is a connection diagram of a display panel 10 and a source driver 30 according to the third embodiment and illustrates connection to the (j−1)th to (j+1)th pixels (P) 11 in the i-th row illustrated in FIG. 1. First, the pixel configuration of the display panel 10 will be described.

The pixels (P) 11 each include one OLED (D1), five transistors (T1 to T5), and one storage capacitor (Cst). The transistors T1 to T5 are of the P-type. T1 functions as an input transistor for selecting a pixel 11 and is controlled using a gate line (Gs).

T2 functions as a driving transistor for controlling supply of current to the OLED. Gate voltage of T2 is supplied from a source line (S) through T1. T3 functions as a voltage monitoring control transistor for controlling connection/disconnection between an anode of the OLED and a monitoring line and is controlled using a gate line (Gmv).

T4 functions as a current monitoring control transistor for controlling connection/disconnection between a cathode of the OLED and the source line and is controlled using a gate line (Gmi). T5 functions as a light emission control transistor for controlling connection/disconnection between the cathode of the OLED and a driving power supply (ELVSS) and is controlled using a gate line (EL).

Figure 12:
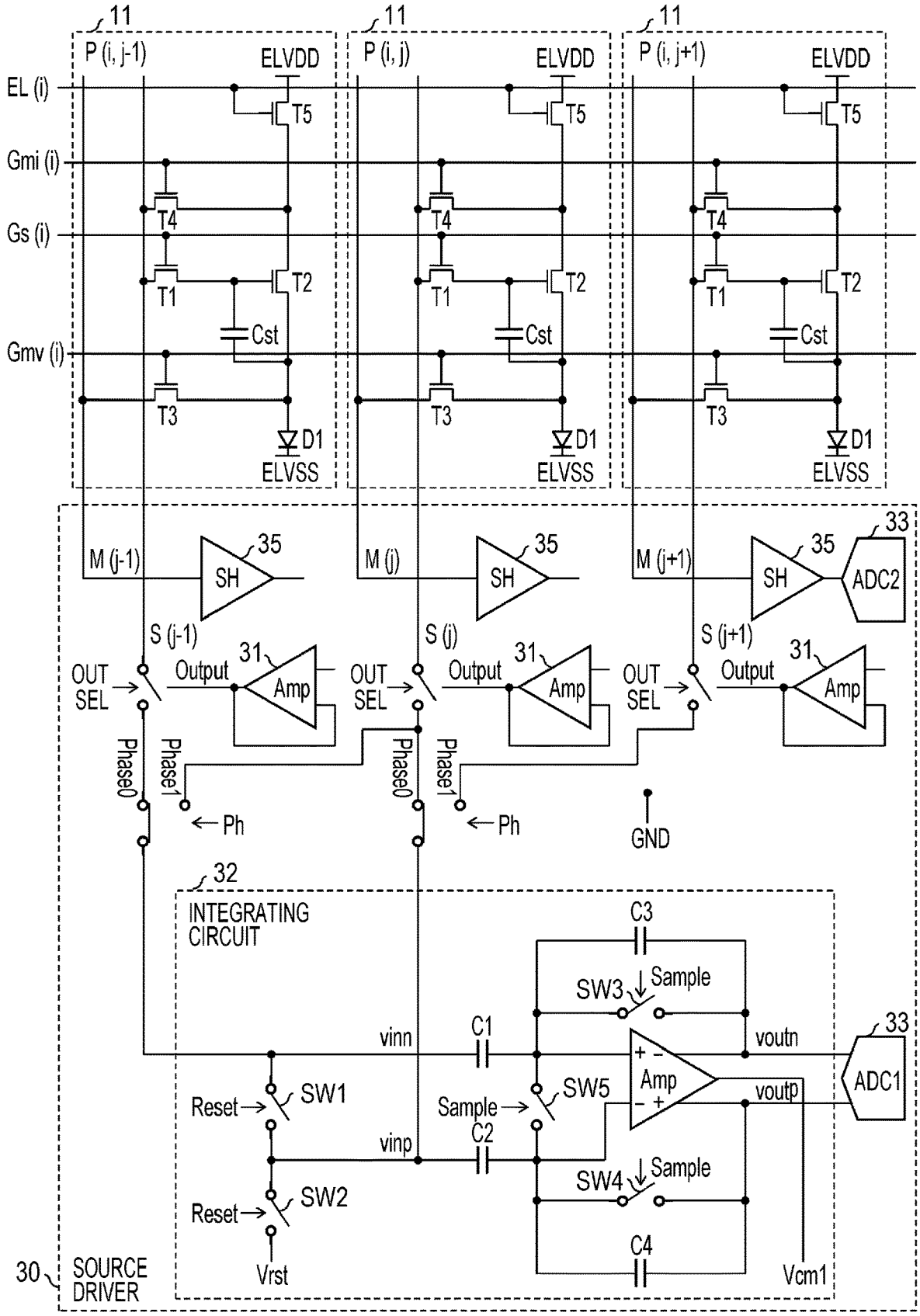
FIG. 12 is a circuit diagram illustrating another example of the connection between the source driver and the pixel circuits.

FIG. 12 illustrates a case of the N type, where T4 and T5 are connected not to the cathode of the OLED but to a drain of T2. In the case of the P type, the cathode of the OLED is located on a drain side of T2, and in both the P type and the N type, T4 and T5 are connected on the drain side of T2. As described in the first embodiment, variation in potential occurs during the sampling period in lines connected to the integrating circuits 32. The above way of connection keeps the variation in potential from affecting gate-source voltage of T2, keeps the gate-source voltage the same, and also keeps driving current of T2 the same during measurement of current.

Next, the configuration of the source driver 30 will be described. The source driver 30 includes the output circuits 31, the phase switches, output selection switches, the (switched capacitor) integrating circuits 32, sample-hold (SH) circuits 35, and ADC1 and ADC2 (33). The integrating circuits 32 have the same configuration as in the first embodiment. Although two ADCs are used here, only one ADC may be provided, instead, and processing may be performed in time series.

Figure 13:
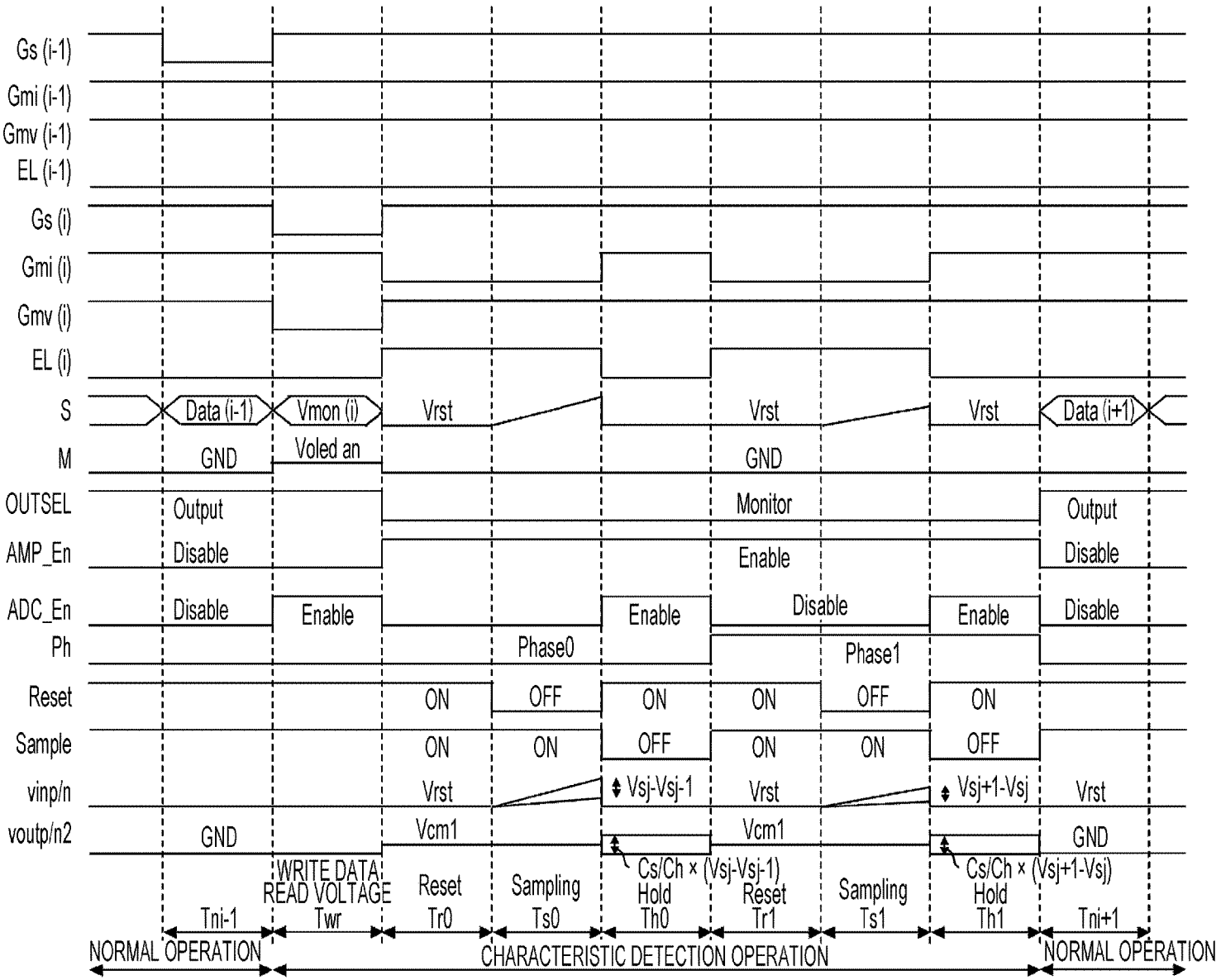
FIG. 13 is a timing chart illustrating the operation of the display device.

The circuit operation according to the third embodiment illustrated in FIG. 11 will be described with reference to a timing chart of FIG. 13. FIG. 13 is a timing chart at a time when the pixels in the first to (i−1)th rows perform the normal operation, the pixels in the i-th row perform the monitoring operation for the driving transistors and OLEDs, and the pixels in the (i+1)th to last rows perform the normal operation. Here, OUTSEL, AMP_En, ADC_En, Ph, Reset, and Sample denote control signals.

Normal Operation

Tni-1 denotes the normal operation period in the (i−1)th row, where, in the (i−1)th row, signals Gs(i−1) and EL(i−1) of the gate line become low and signals Gmi(i−1) and Gmv(i−1) become high and, other than in the (i−1)th row, signals EL of the gate lines become low and signals Gs, Gmi, and Gmv become high.

The control signals OUTSEL become high, and the output selection switches of the source driver 30 connect the output circuits 31 and the source lines to each other. (Output) In the pixels 11 in the (i−1)th row, T1 turn on, T3 and T4 turn off, and the source driver 30 supplies data voltages according to data Data(i−1) to gates of T2.

In the pixels 11 other than in the (i−1)th row, T1, T3, and T4 turn off. In all the pixels 11, T5 turn on, and cathodes of the OLEDs are connected to ELVSS.

Correction Operation

Twr denotes a period in which monitoring voltages for the monitoring operation are written and anode voltages of the OLEDs are read. The signals Gs(i) and Gmv(i) of the gate line in the i-th row become low, and the signals Gs of the gate lines other than in the i-th row become high. As in the normal operation, in all the pixels (P) 11, T4 turn off, T5 turn on, and the cathodes of the OLEDs are connected to ELVSS.

In the pixels in the i-th row, T1 turn on, T3 turn on, the source driver 30 supplies the monitoring voltages Vmon(i) to the gates of T2, and the drains of T2 (anodes of the OLEDs) and the monitoring lines are connected to each other.

The monitoring lines have anode voltages Voled_an of the OLEDs, and the anode voltages Voled_an are input to the SH circuits 35 of the source driver 30 in the corresponding columns. At the same time, ADC_En switch from low to high. The ADC2 (33) sequentially converts Voled_an(j), which is an output of the SH circuit 35 in each column, into digital data. As a result of the above operation, data can be written for the pixels 11 and the anode voltages of the OLEDs can be measured in a monitored row. In the pixels (P) 11 other than in the i-th row, T1 turn off and T3 turn off. This state continues until the characteristic detection operation in the i-th row is completed.

Tr0, Ts0, Th0, Tr1, Ts1, and Th1 denote reset periods, sampling periods, and holding periods in Phase0/1 of the monitoring operation, which are the same operations as in the first embodiment. Although current is measured with a driving transistor and an OLED connected in series with each other from a source line in the third embodiment, current may be measured from a monitoring line as in the first embodiment, instead.

The control signals during the reset period in Phase0 of the monitoring operation are as follows. AMP_En, Sample, and Reset become high, and OUTSEL, ADC_En, and Ph become low.

The integrating circuits 32 switch from Disable to Enable, and the outputs voutp and voutn of the fully differential amplifier circuits are initialized to Vcm1. S(j−1) and S(j) are connected to the inverting input vinn and the non-inverting input vinp, respectively, and initialized to Vrst. Vrst is desirably ELVSS, and in the case of Nch illustrated in FIG. 12, Vrst is desirably ELVDD.

A signal Gmi(i) of the gate line in the i-th row becomes low and a signal EL(i) becomes high. In the pixels in the i-th row, T4 turn on, T5 turn off, and the cathodes of the OLEDs are now connected not to ELVSS but to the source lines. In the pixels (P) 11 other than in the i-th row, the cathodes of the OLEDs keep connected to ELVSS until the detection operation is completed.

During the sampling period in Phase0 of the monitoring operation, Reset switches from high to low. C1 is charged on the basis of current from T2 and D1 of P(i, j−1) connected in series with each other, and C2 is charged on the basis of current from T2 and D1 of P(i, j) connected in series with each other. Consequently, potentials of S(j−1) and S(j) increase.

As a result, charges obtained by time-integrating the currents from T2 and D1 connected in series with each other in the pixels 11 with the sampling period are accumulated in C1 and C2. During this period, the potentials of the source lines increase, and the source-drain voltages of T2 decrease. Since the gate-source voltages are kept the same by Cst, however, the driving currents of T2 are kept the same. When measurement errors are caused by variation in the potentials of the source lines during the sampling period, the measurement errors can be reduced by adjusting the ratios of Cs to Ch as described in the first embodiment.

During the holding period in Phase0 of the monitoring operation, the signal Gmi(i) of the gate line in the i-th row becomes high and the signal EL(i) becomes low. In the pixels in the i-th row, T4 turn off, T5 turn on, and the cathodes of the OLEDs are now connected not to the source lines but to ELVSS. Current therefore no longer flows into the source lines.

At the same time, Reset and ADC_En switch from low to high, and Sample switches from high to low. Charge is transferred from C1 to C3 and C2 to C4. The outputs of the integrating circuits 32 become products Cs/Ch×(Vsj−Vsj−1) of differences between time integrals of the currents from T2 and D1 of P(i, j) and P(i, j−1) connected in series with each other and the gain and held until being processed by the ADC1 (33).

The outputs of the integrating circuits 32 are sequentially input to the ADC1 (33) and converted into digital data. Since the outputs are processed using differences between adjacent pixels, common-mode noise in the monitoring lines and the power supply voltage is removed, and the measurement errors are reduced. Phase0 of the monitoring operation thus ends, and Phase1 starts.

Figure 14:
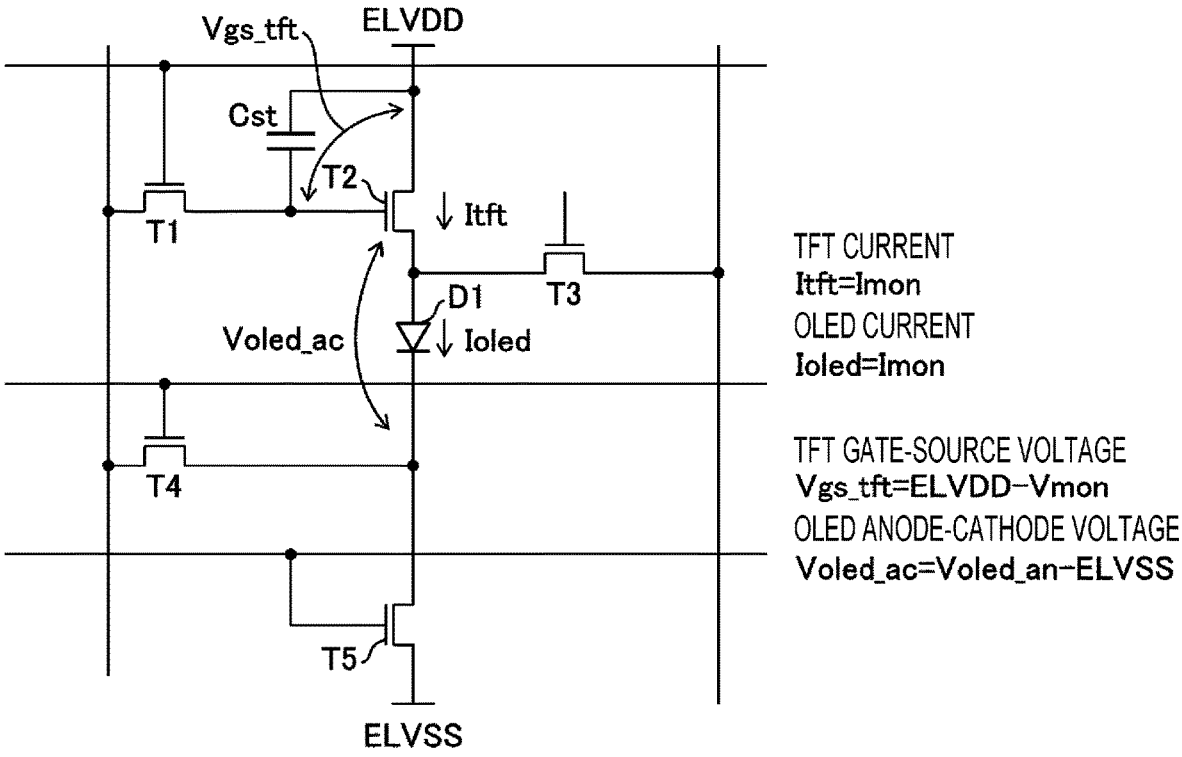
FIG. 14 is a correlation diagram illustrating a result of measurement of one of the pixel circuits illustrated in FIG. 11 and a relationship between current and voltage of each device.

As a result of the operations in Phase0 and Phase1, digital data regarding the anode voltage Voled_an of the OLED and the current Imon of the driving transistor and the OLED in each column can be obtained. As illustrated in FIG. 14, current-voltage characteristics of the driving transistor and the OLED can be calculated, and correction data for the driving transistor and the OLED can be calculated.

Additional Remarks

The present disclosure is not limited to the above-described embodiments. The above-described embodiments may be modified in various ways within the scope defined by the claims, and the technical scope of the present disclosure also includes embodiments achieved by appropriately combining together technical means disclosed in different embodiments. Furthermore, by combining together technical means disclosed in the embodiments, new technical features can be achieved.

The present disclosure contains subject matter related to that disclosed in U.S. Provisional Patent Application No. 62/798,756 filed in the US Patent Office on Jan. 30, 2019, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a current generation circuit that generates a current that serves as a reference;

a plurality of pixel circuits arranged adjacent to one another;

a driving circuit that supplies a same current to each of the plurality of pixel circuits;

a measuring circuit that measures the current using an integrating circuit; and a correction circuit that corrects degradation of other pixel circuits on a basis of a result of the measurement obtained by the measuring circuit using the current that serves as the reference, wherein the current generation circuit includes a reference pixel circuit having a same configuration as each of the plurality of pixel circuits, the driving circuit supplies the current that serves as the reference to the reference pixel circuit and does not supply the current to pixel circuits adjacent to the reference pixel circuit, and the measuring circuit measures the current that serves as the reference from differences from currents flowing into the adjacent pixel circuits.

2. The display device according to claim 1, wherein the current generation circuit includes a current source capable of adjusting the current to any amount of current through register control.

3. The display device according to claim 1, wherein the reference pixel circuit operates only during measurement of current and does not degrade over time.

4. The display device according to claim 1, wherein the integrating circuit includes an integrating circuit capable of adjusting gain by adjusting a capacitance ratio.

5. The display device according to claim 1, wherein the plurality of pixel circuits and the measuring circuit are AC coupled with each other.

6. The display device according to claim 1, further comprising:

a switch that switches connection between the plurality of pixel circuits and the measuring circuit, wherein the measuring circuit measures differences from currents flowing into adjacent pixel circuits.

7. The display device according to claim 6, wherein the measuring circuit measures differences from currents flowing into adjacent pixel circuits of a same color.

8. The display device according to claim 6, wherein the measuring circuit switches the connection between the plurality of pixel circuits and the measuring circuit, measures the differences from the currents flowing into the adjacent pixel circuits a plurality of times, and removes an offset of the measuring circuit.

9. A display device comprising:

a current generation circuit that generates a current that serves as a reference;

a plurality of pixel circuits arranged adjacent to the current generation circuit;

a driving circuit that supplies a same current to each of the plurality of pixel circuits;

a measuring circuit that measures an anode voltage of each of a plurality of organic light-emitting devices and also measures, using an integrating circuit, a current flowing into a driving transistor and a corresponding one of the plurality of organic light-emitting devices in each of the plurality of pixel circuits; and a correction circuit that corrects degradation of other pixel circuits on a basis of a result of the measurement obtained by the measuring circuit using the current that serves as the reference, wherein the current generation circuit includes a reference pixel circuit having a same configuration as each of the plurality of pixel circuits, the driving circuit supplies the current that serves as the reference to the reference pixel circuit and does not supply the current to the pixel circuits adjacent to the reference pixel circuit, and the measuring circuit measures the current that serves as the reference from differences from currents flowing into the adjacent pixel circuits.

10. The display device according to claim 9, wherein the current generation circuit includes a current source capable of adjusting the current to any amount of current through register control.

11. The display device according to claim 9, wherein the reference pixel circuit operates only during measurement of current and does not degrade over time.

12. The display device according to claim 9, wherein the integrating circuit includes an integrating circuit capable of adjusting gain by adjusting a capacitance ratio.

13. The display device according to claim 9, wherein the plurality of pixel circuits and the measuring circuit are AC coupled with each other.

14. The display device according to claim 9, further comprising:

a switch that switches connection between the plurality of pixel circuits and the measuring circuit, wherein the measuring circuit measures differences from currents flowing into the adjacent pixel circuits.

15. The display device according to claim 14, wherein the measuring circuit measures differences from currents flowing into adjacent pixel circuits of a same color.

16. The display device according to claim 14, wherein the measuring circuit switches the connection between the plurality of pixel circuits and the measuring circuit, measures the differences from the currents flowing into the adjacent pixel circuits a plurality of times, and removes an offset of the measuring circuit.

* * * * *